US010260511B2

(12) United States Patent
Li

(10) Patent No.: US 10,260,511 B2
(45) Date of Patent: Apr. 16, 2019

(54) CEILING FAN

(71) Applicant: Wen Chin Li, Taichung (TW)

(72) Inventor: Wen Chin Li, Taichung (TW)

( * ) Notice: Subject to any disclaimer, the term of this patent is extended or adjusted under 35 U.S.C. 154(b) by 325 days.

(21) Appl. No.: 15/375,126

(22) Filed: Dec. 11, 2016

(65) Prior Publication Data

US 2018/0128276 A1 May 10, 2018

(30) Foreign Application Priority Data

Nov. 10, 2016 (TW) ..... 105217178 A

(51) Int. Cl.

| | |
|---|---|
| ***F04D 25/08*** | (2006.01) |
| ***F04D 25/06*** | (2006.01) |
| ***F04D 29/34*** | (2006.01) |
| ***F04D 29/32*** | (2006.01) |
| ***F04D 29/38*** | (2006.01) |
| ***F04D 29/64*** | (2006.01) |

(52) U.S. Cl.

CPC ..... *F04D 25/088* (2013.01); *F04D 25/06* (2013.01); *F04D 29/329* (2013.01); *F04D 29/34* (2013.01); *F04D 29/38* (2013.01); *F04D 29/644* (2013.01)

(58) Field of Classification Search

CPC ..... F04D 25/088; F04D 25/06; F04D 29/329; F04D 29/34; F04D 29/38; F04D 29/644

USPC ..... 416/210 R, 227 R, 227 A

See application file for complete search history.

(56) References Cited

U.S. PATENT DOCUMENTS 8,845,293 B1 * 9/2014 Lowe ..... F04D 29/34 416/205

2006/0078431 A1 * 4/2006 Blateri ..... F04D 25/088 416/210 R

* cited by examiner

*Primary Examiner* — Lindsay Low
*Assistant Examiner* — John Bailey
(74) *Attorney, Agent, or Firm* — Rosenberg, Klein & Lee

(57) ABSTRACT

A ceiling fan includes a body having a disk which is driven by a motor. Multiple frames are connected to the disk and each frame has a rod which is connected between at least two seats and the disk. The at least two seats each are positioned by an inclination angle relative to a horizontal plane. A height difference is formed between the at least two seats of each rod. A blade is connected to each of the at least two seats of each rod of each frame. The ceiling fan includes less number of seats while more blades are connected to the seats.

10 Claims, 11 Drawing Sheets

CEILING FAN

BACKGROUND OF THE INVENTION

1. Fields of the Invention

The present invention relates to a ceiling fan, and more particularly, to a ceiling fan having less number of frames for being connected with multiple blades.

2. Descriptions of Related Art

The conventional ceiling fan 9 is disclosed in FIG. 11 and comprises a body 91 and a motor 911 is located within the body 91. A disk 95 is connected to and driven by the motor 911, and multiple frames 96 are connected to the disk 95 and one blade 97 is connected to each of the frames 96. The blades 97 are rotated to create air flow. A tube 92 extends from the top of the body 91 and has a semi-spherical head 921 which is supported by a fixture 93 fixed to the ceiling. A housing 94 is mounted to the fixture 93 to hide the fixture 93 therein. A cable 912 extends from the ceiling and extends through the tube 92 and is electrically connected to the motor 911.

Because each frame 96 can only be connected with one blade 97, so that the number of the blades 97 is limited by the limited space that the frames 96 occupy. In other words, when the users want to cool the temperature of a room quickly, the operational speed of the motor 911 has to be increased so as to rotate the limited number of the blades 97. Besides, each blade 97 has to be made to have an inclination angle which requires extra machining and checking processes.

The present invention intends to provide a ceiling fan wherein each frame is connected with multiple blades so as to eliminate the shortcomings mentioned above.

SUMMARY OF THE INVENTION

The present invention relates to a ceiling fan and comprise a body having a disk, a motor and a motor casing, wherein the motor is received in the motor casing and the disk is rotatably connected to the motor casing. The disk is driven by the motor. Multiple frames are connected to the disk and each frame has a rod and at least two seats which are connected to the first end of the rod. The at least two seats each are positioned by an inclination angle relative to a horizontal plane. The height difference is formed between the at least two seats of each rod. The rods each have a second end thereof connected to the disk. A blade is connected to each of the at least two seats of each rod of each frame connected to a blade.

Preferably, the length of each of the blades is longer than the length of each frame. A light is connected to the underside of the body.

Preferably, the at least two seats each have a recess and multiple threaded holes are defined in the inner bottom of the recess. The blade has one end fixed in recess by extending through multiple screws through the blade and threadedly connected to the threaded holes.

Preferably, there are three frames and six blades are connected to the three frames. The length of each of the blades is the same as the length of each frame.

Preferably, there are six frames and twelve blades are connected to the six frames. Three of the frames have a first length and the other three of the frames have a second length. The frames of the first length are located alternatively between the frames of the second length.

Preferably, there are four frames and eight blades are connected to the four frames. The length of each of the blades is the same as the length of each frame.

Preferably, there are three seats connected to the rod of each of the frames. The height difference is formed between the three seats. Each of the seats is positioned by the inclination angle relative to a horizontal plane.

Preferably, there are three frames and nine blades are connected to the three frames. The length of each of the blades is the same as the length of each frame.

Preferably, the inclination angle is between 5 to 30 degrees.

Preferably, the disk and the frames are made by way of casting and connected to each other by screws.

The primary object of the present invention is to provide a ceiling fan which needs less number of the frames to be connected to more blades so as to increase the efficiency of generating air flows. The high efficiency can be obtained by not increasing the operational speed of the motor. In other words, the ceiling fan has high efficiency of generating air flows at lower operational speed of the motor.

Another object of the present invention is to provide a ceiling fan which uses shorter blades so that the blades tend not to be deformed due to smaller torque cause by gravity.

Yet another object of the present invention is to provide a ceiling fan wherein the frames are made by way of casting so as to have the inclination angle when the frames are made. This makes the manufacturing be simple and efficient.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
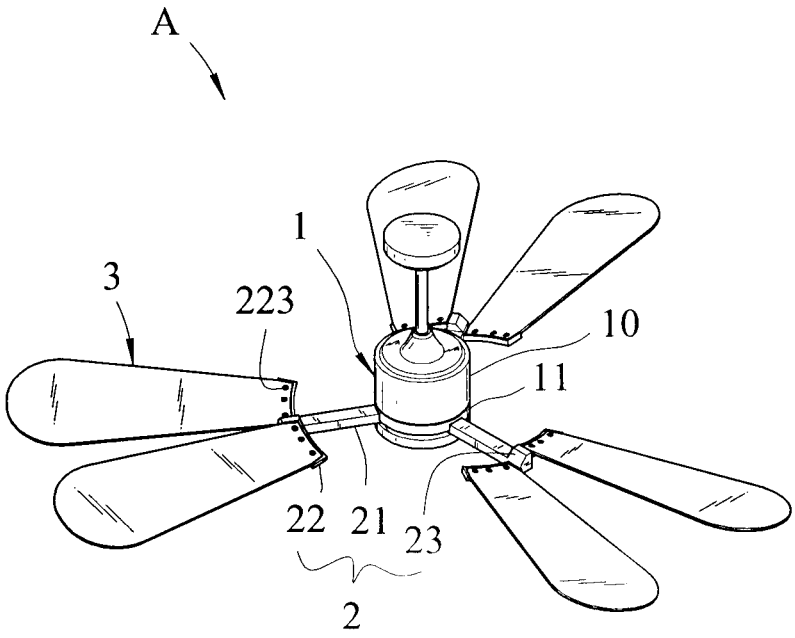
FIG. 1 is a perspective view to show the ceiling fan of the present invention.
Figure 2:
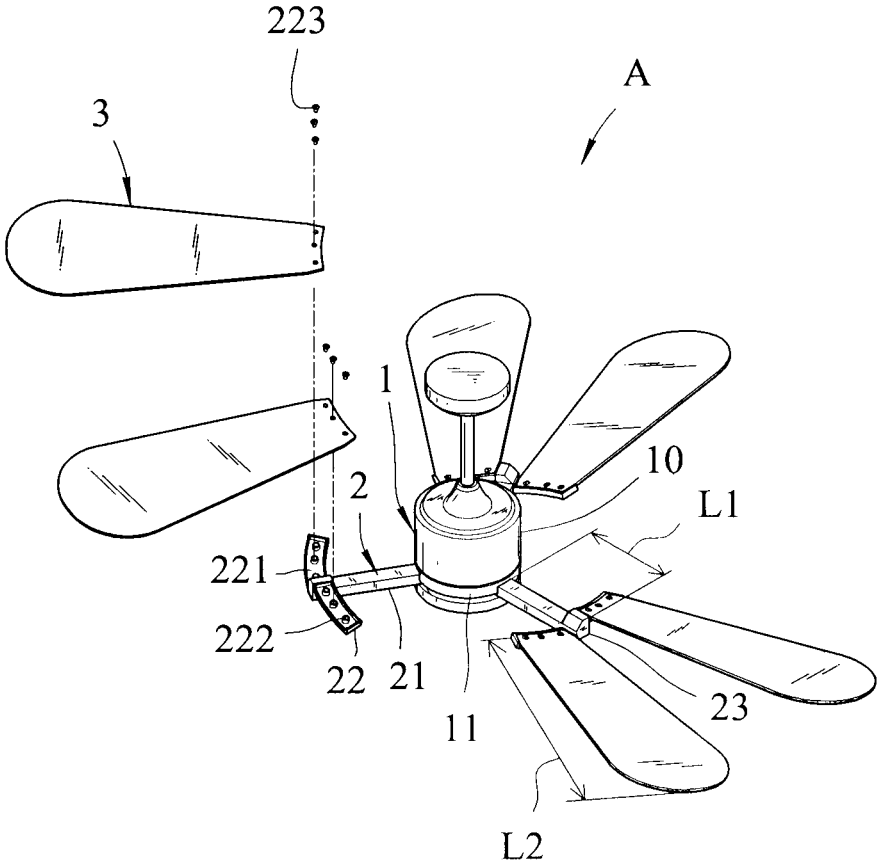
FIG. 2 is an exploded view of the ceiling fan of the present invention.
Figure 3:
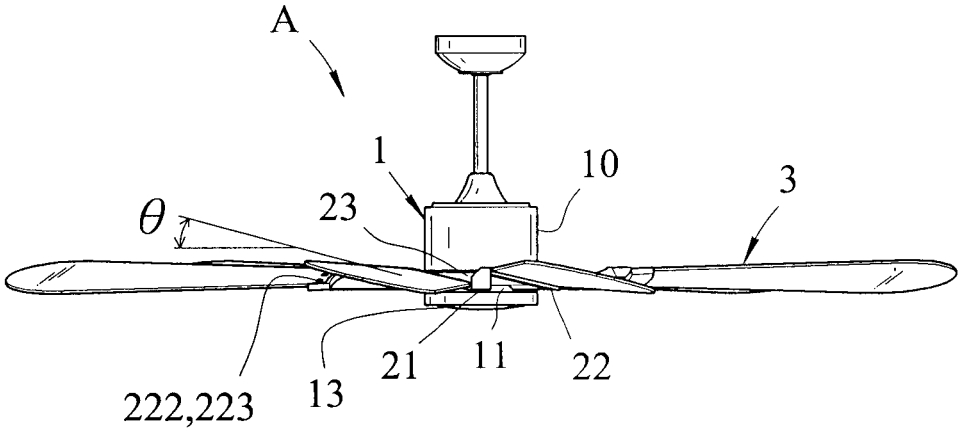
FIG. 3 is a side view of the ceiling fan of the present invention.

Referring to FIGS. 1 to 3, the ceiling fan "A" of the present invention comprises a body 1, multiple frames 2 and multiple blades 3. The body 1 has a tube extending from the top thereof and the tube is connected to a support unit on the ceiling. The body 1 has a disk 11, a motor and a motor casing 10, wherein the motor is received in the motor casing 10 and the disk 11 is rotatably connected to the motor casing 10. The disk 11 is driven by the motor. A light 13 is connected to the underside of the body 1.

Figure 10:
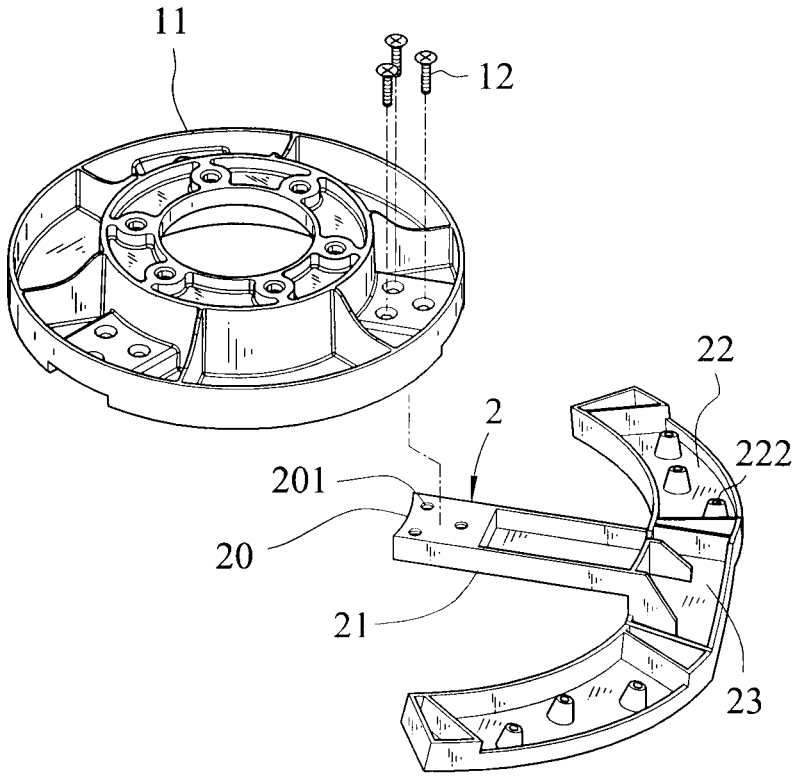
FIG. 10 is an exploded view of the disk and the frame of the ceiling fan of the present invention.
Figure 11:
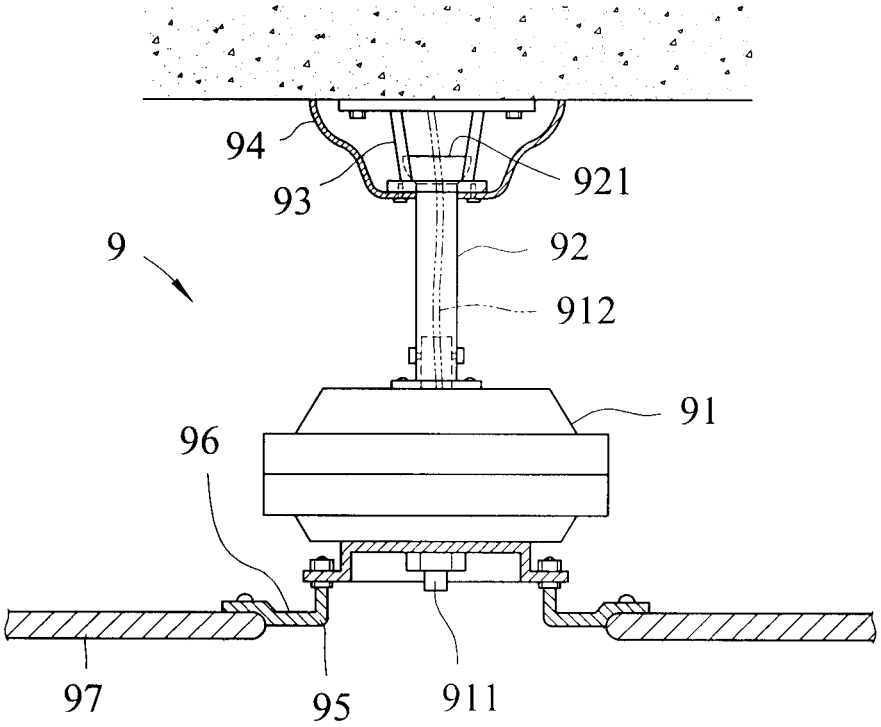
FIG.11 PRIOR ART
FIG. 11 shows the conventional ceiling fan.

The multiple frames 2 each have a rod 21 and two seats 22 are connected to the first end of the rod 21. The two seats 22 each are positioned by an inclination angle "θ" relative to a horizontal plane. The inclination angle "θ" is between 5 to 30 degrees. A height difference 23 is formed between the two seats 22 of each rod 21. The rods 21 each have a connection portion 20 formed on the second end thereof so as to be connected to the disk 11 by extending screws 12 through the disk 11 and connected to the threaded holes 201 defied in the connection portion 20 as shown in FIG. 10. The two seats 22 each have a recess 221 and multiple threaded holes 222 are defined in the inner bottom of the recess 221. The blade 3 has one end fixed in recess 221 by extending through multiple screws 223 through the blade 3 and threadedly connected to the threaded holes 222. Therefore, the blades 3 each are positioned by the inclination angle "θ". The length L2 of each of the blades 3 is longer than the length L1 of each frame 2.

In this embodiment, there are three frames 2 and six blades 3 are connected to the three frames 2. The length L2 of each of the blades 3 is the same as the length L1 of each frame 2. That is to say, the ceiling fan "A" has six blades and only three frames 2 are needed.

Figure 4:
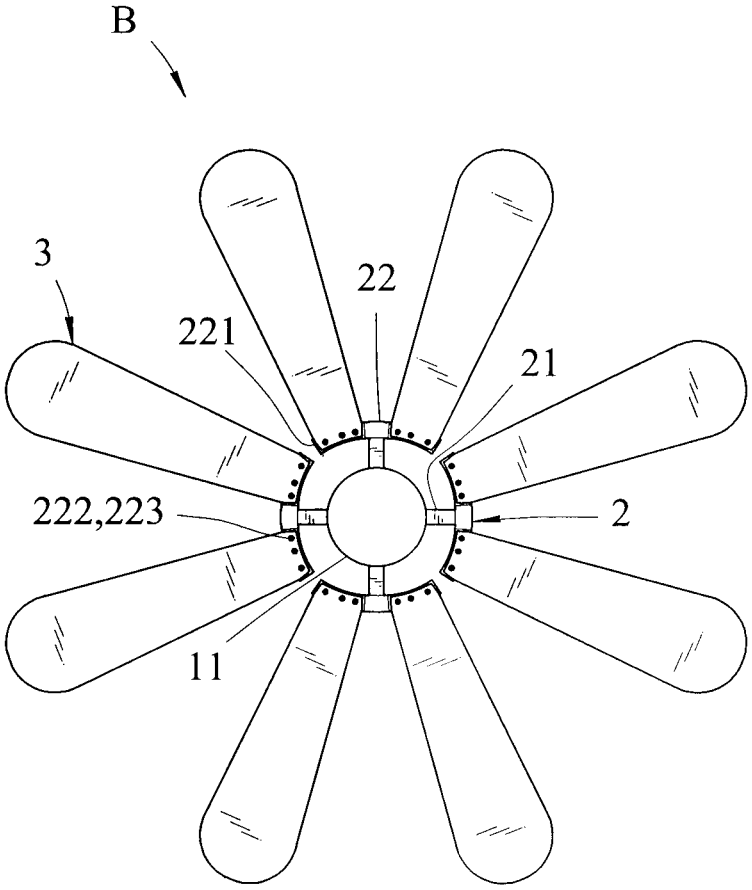
FIG. 4 is a top view of the second embodiment of the ceiling fan of the present invention.

FIG. 4 shows the second embodiment of the present invention, wherein the ceiling fan "B" has four frames 2 and eight blades 3 are connected to the four frames 2. The length L2 of each of the blades 3 is the same as the length L1 of each frame 2.

Figure 5:
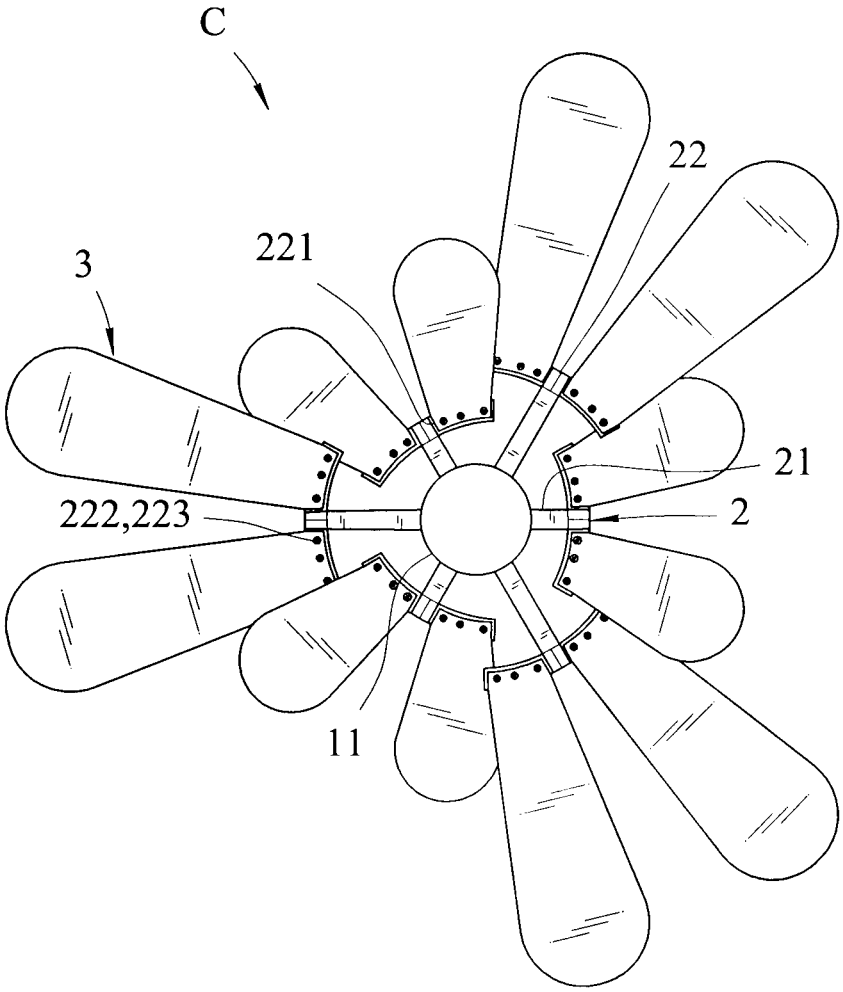
FIG. 5 is a top view of the third embodiment of the ceiling fan of the present invention.

FIG. 5 shows the third embodiment of the present invention, wherein the ceiling fan "C" has six frames 2 and twelve blades 3 are connected to the six frames 2. Three of the frames 2 have a first length and the other three of the frames 2 have a second length which is different from the first length. The frames 2 of the first length are located alternatively between the frames 2 of the second length.

Figure 6:
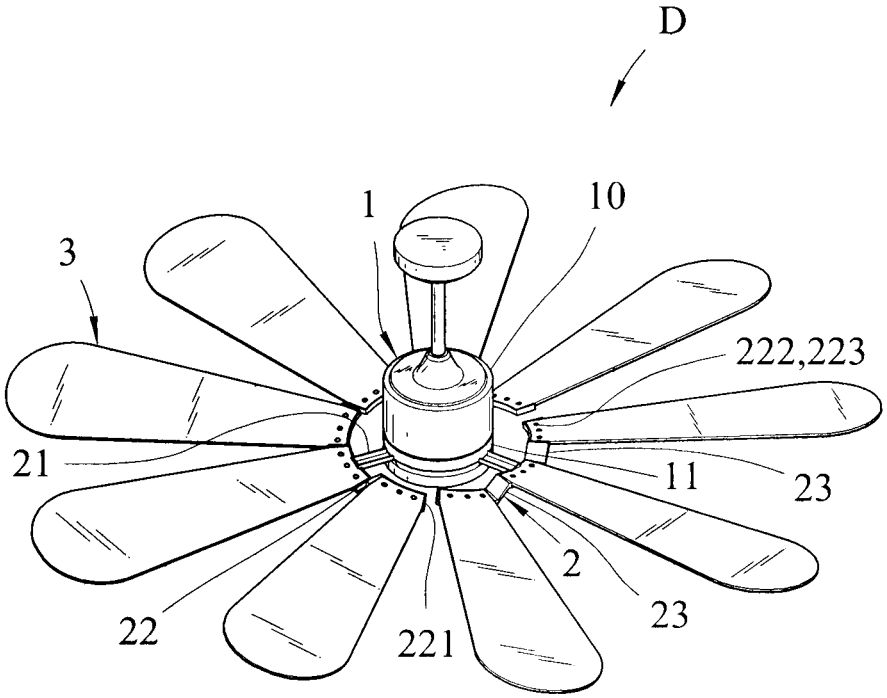
FIG. 6 is a perspective view to show the fourth embodiment of the ceiling fan of the present invention.
Figure 7:
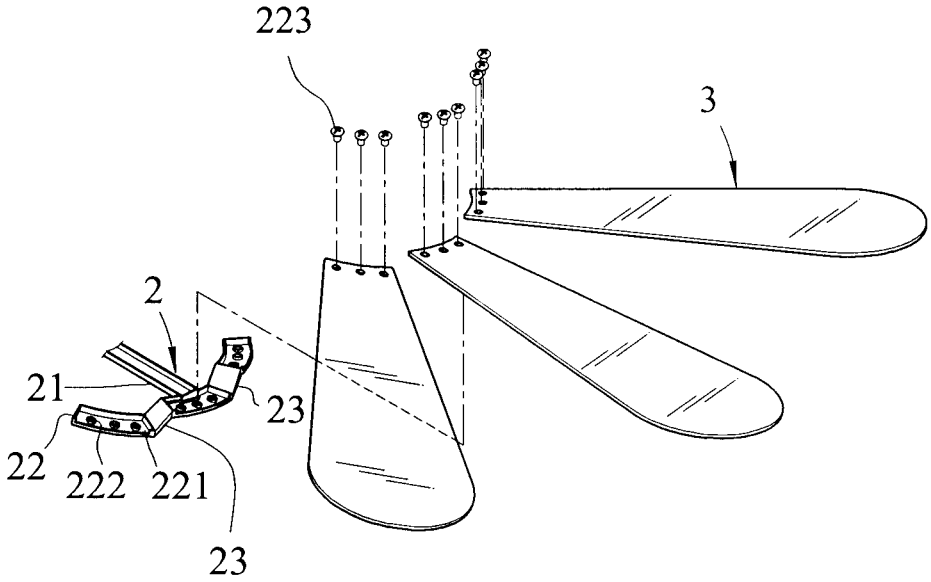
FIG. 7 is an exploded view of the fourth embodiment of the ceiling fan of the present invention.
Figure 8:
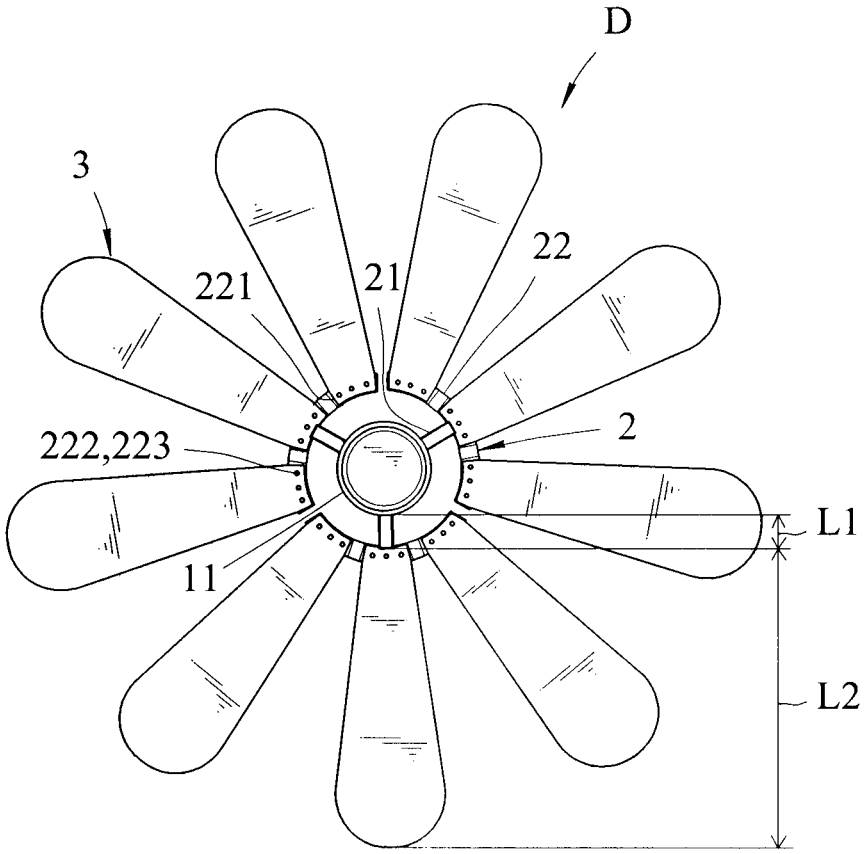
FIG. 8 is a top view of the fourth embodiment of the ceiling fan of the present invention.
Figure 9:
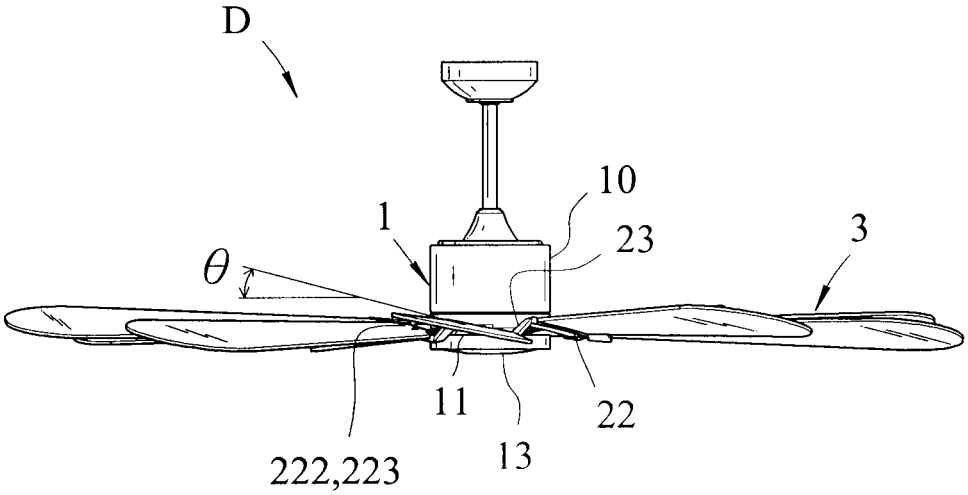
FIG. 9 is a side view of the fourth embodiment of the ceiling fan of the present invention.

FIGS. 6 to 9 show the fourth embodiment of the present invention, wherein the ceiling fan "D", wherein there are three seats 22 connected to the rod 21 of each of the frames 2. The height difference 23 is formed between the three seats 22. Each of the seats 22 is positioned by the inclination angle "θ" relative to a horizontal plane as shown in FIG. 9. There are two height differences 23 formed between the three frames 2 as shown in FIG. 7. The inclination angle "θ" is between 5 to 30 degrees. Each seat 22 is connected to one blade 3 by screws 223. In other words, there are nine blades 3 are available with only three frames 2 needed.

As shown in FIGS. 6, 9 and 10, the disk 11 and the frames 2 are made by way of casting and connected to each other by screws 12. Because the frames 2 are made by way of casting so that each frame 2 has the inclination angle "θ" when the frame 2 is made. That is to say, when the blades 3 are installed to the frames 2, the blades 3 are positioned by the inclination angle "θ".

While we have shown and described the embodiment in accordance with the present invention, it should be clear to those skilled in the art that further embodiments may be made without departing from the scope of the present invention.

What is claimed is:

1. A ceiling fan comprising:

a body having a disk, a motor and a motor casing, the motor received in the motor casing and the disk rotatably connected to the motor casing, the disk being driven by the motor;

multiple frames each having a rod and at least two seats which are connected to a first end of the rod, the at least two seats each being positioned by an inclination angle relative to a horizontal plane, a height difference formed between the at least two seats of each rod, the rods each having a second end thereof connected to the disk, and a blade connected to each of the at least two seats of each rod of each frame connected to a blade.

2. The ceiling fan as claimed in claim 1, wherein a length of each of the blades is longer than a length of each frame, a light is connected to an underside of the body.

3. The ceiling fan as claimed in claim 2, wherein the at least two seats each have a recess and multiple threaded holes defined in an inner bottom of the recess, the blade has one end fixed in the recess by extending through multiple screws through the blade and threadedly connected to the threaded holes.

4. The ceiling fan as claimed in claim 2, wherein there are three frames and six blades are connected to the three frames, the length of each of the blades is the same as the length of each frame.

5. The ceiling fan as claimed in claim 2, wherein there are six frames and twelve blades are connected to the six frames, three of the frames have a first length and the other three of the frames have a second length, the frames of the first length are located alternatively between the frames of the second length.

6. The ceiling fan as claimed in claim 2, wherein there are four frames and eight blades are connected to the four frames, the length of each of the blades is the same as the length of each frame.

7. The ceiling fan as claimed in claim 2, wherein there are three seats connected to the rod of each of the frames, the height difference is formed between the three seats, each of the seats is positioned by the inclination angle relative to a horizontal plane.

8. The ceiling fan as claimed in claim 2, wherein there are three frames and nine blades are connected to the three frames, the length of each of the blades is the same as the length of each frame.

9. The ceiling fan as claimed in claim 1, wherein the inclination angle is between 5 to 30 degrees.

10. The ceiling fan as claimed in claim 1, wherein the disk and the frames are made by way of casting and connected to each other by screws.

* * * * *